United States Patent [19]

Kurita

[11] Patent Number: 4,591,196

[45] Date of Patent: May 27, 1986

[54] OUTSIDE DOOR HANDLE ASSEMBLY

[75] Inventor: Tokutaro Kurita, Kawasaki, Japan

[73] Assignee: Kokusan Kinzoku Kogyo Kabushiki Kaisha, Tokyo, Japan

[21] Appl. No.: 679,100

[22] Filed: Dec. 7, 1984

Related U.S. Application Data

[63] Continuation of Ser. No. 335,367, Dec. 29, 1981, abandoned.

[51] Int. Cl.[4] ..... E05B 3/00

[52] U.S. Cl. ..... 292/336.3; 403/69; 403/70; 403/353

[58] Field of Search ..... 292/336.3, 347, DIG. 65, 292/196, 97, 139; 403/69, 70, 163, 353, 13, 14, 71

[56] References Cited

U.S. PATENT DOCUMENTS

| | | | |
|---|---|---|---|
| 2,543,374 | 2/1951 | Noguera | 403/353 X |
| 2,937,045 | 5/1960 | Leslie et al. | 292/336.3 |
| 3,497,252 | 2/1970 | Laing | 292/336.3 |
| 3,679,249 | 7/1972 | Hoffmann | 403/71 X |
| 3,967,844 | 7/1976 | Torii et al. | 292/DIG. 65 X |
| 4,258,940 | 3/1981 | Fudge | 403/353 X |
| 4,343,501 | 8/1982 | Meeks | 292/336.3 |

FOREIGN PATENT DOCUMENTS

| | | | |
|---|---|---|---|
| 1940453 | 2/1971 | Fed. Rep. of Germany | 292/336.3 |
| 2229586 | 2/1973 | Fed. Rep. of Germany | 292/336.3 |
| 2140589 | 2/1973 | Fed. Rep. of Germany | 292/336.3 |
| 2131398 | 2/1979 | Fed. Rep. of Germany | 292/336.3 |

*Primary Examiner*—Kenneth J. Dorner
*Assistant Examiner*—Russell W. Illich
*Attorney, Agent, or Firm*—Fleit, Jacobson, Cohn & Price

[57] ABSTRACT

The invention resides in an outside door handle assembly which comprises a door handle pivotable mounted on a door of an automotive vehicle; and a door latch operating rod having a L-shaped rod end which is pivotably attached to an extension of said door handle after assemblying thereto in a push-in and turning connection mode and without afterfabrication at site. For this purpose, the said outside door handle assembly comprises a door handle pivotably mounted on a door of an automotive vehicle, a door latch operating rod having a L-shaped end, and an arm projection made integral with the said door handle, said rod end being pivotably assembled with said arm projection in a push-in and turning assemblying manner.

1 Claim, 9 Drawing Figures

OUTSIDE DOOR HANDLE ASSEMBLY

This is a continuation of application Ser. No. 335,367, filed Dec. 29, 1981, now abandoned.

BACKGROUND OF THE INVENTION

The present invention relates to improvements in and relating to the door handle assembly, especially adapted for use on automotive vehicles. The handle of such door handle assembly is connected mechanically through a rather long rod with the door latch operating mechanism in such a way that when the door handle is raised manually upwards against spring action, the door latch is released, as is well known among those skilled in the art. When the operator has released his hand from the door handle, the handle is returned from the upper raised position to the lower regular one automatically by spring action.

In the conventional art, the mechanical pivotable connection of the door handle with the door latch operating rod must be carried out through rod-end bending, rod-end press-out job or the like, for the purpose of unintentional slip-out disengagement of the rod from the door handle assembly while the latter is in service. However, such fabrication is troublesome and uneconomical on the production line.

It is one of the object of the present invention to provide an improved door handle assembly provided with a highly convenient and well-functional rod-handle pivot connection to be assembled in a specifically selected push-in and turning mode, requiring no mechanical fabrication job on site.

This and further objects, features and advantages of the invention will become more apparent as the description progress with reference to the accompanying drawings.

DETAILED DESCRIPTION OF THE INVENTION

Now referring to the accompanying drawings, substantially a preferred embodiment will be described in detail.

Numeral 1 represents a somewhat elongated door handle arm proper having a thickened edge 1*a* acting as a finger stop for easy manipulation of the door handle.

Symbols 2 and 3 are a pair of projecting arms which are made integral with the handle arm proper 1 and have somewhat different configurations from each other.

Figure 1:
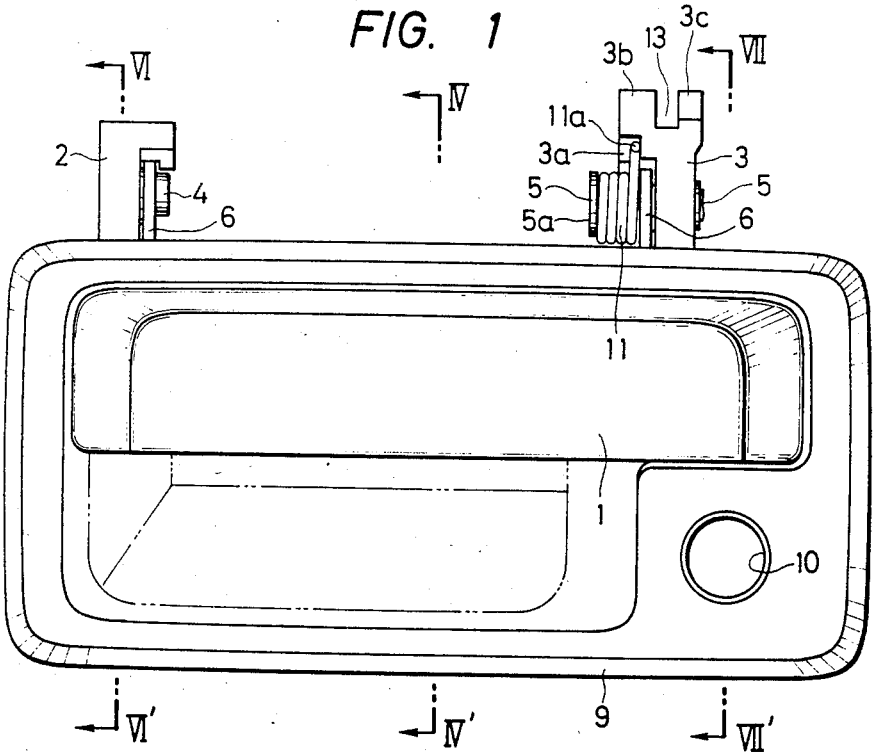
FIG. 1 is a front view of a preferred embodiment of the door handle assembly, however, without showing the door latch-operating rod to be pivotably attached thereto.
Figure 2:
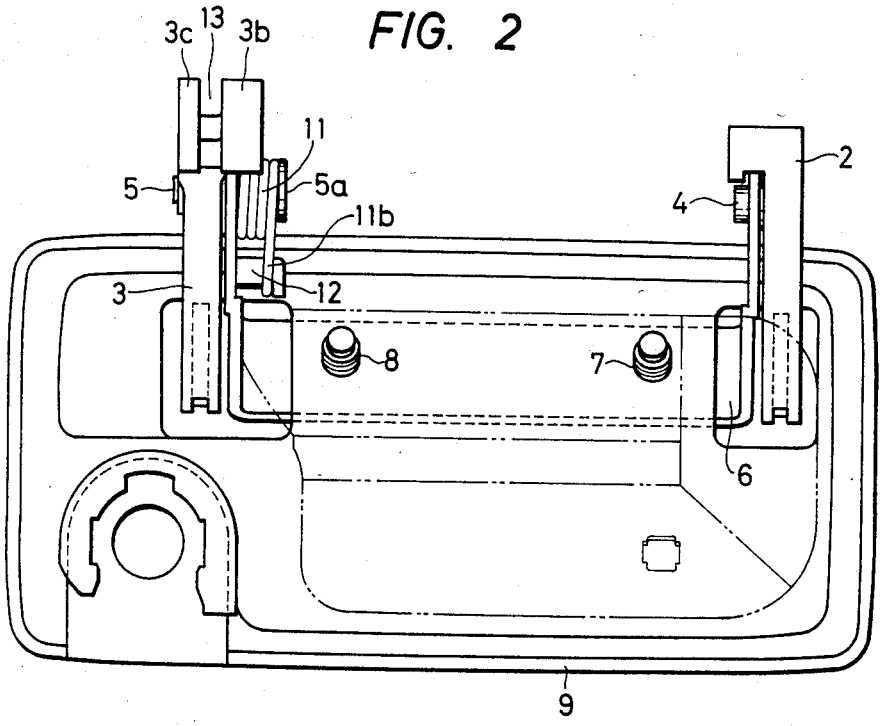
FIG. 2 is a rear side view of the door handle assembly shown in FIG. 1.
Figure 4:
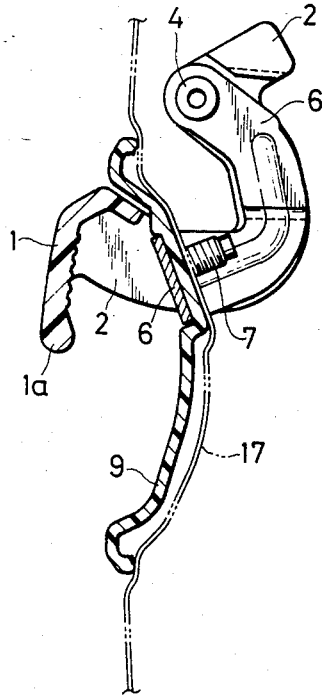
FIG. 4 is a cross-section taken along a section line IV–IV′ in FIG. 1.
Figure 6:
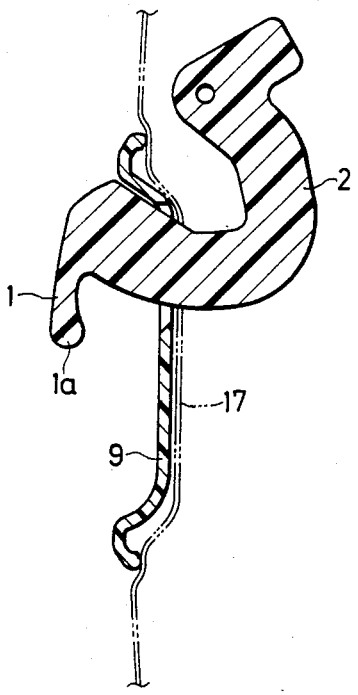
FIG. 6 is a cross-section taken along the section line VI′—VI′ shown in FIG. 1.
Figure 8:
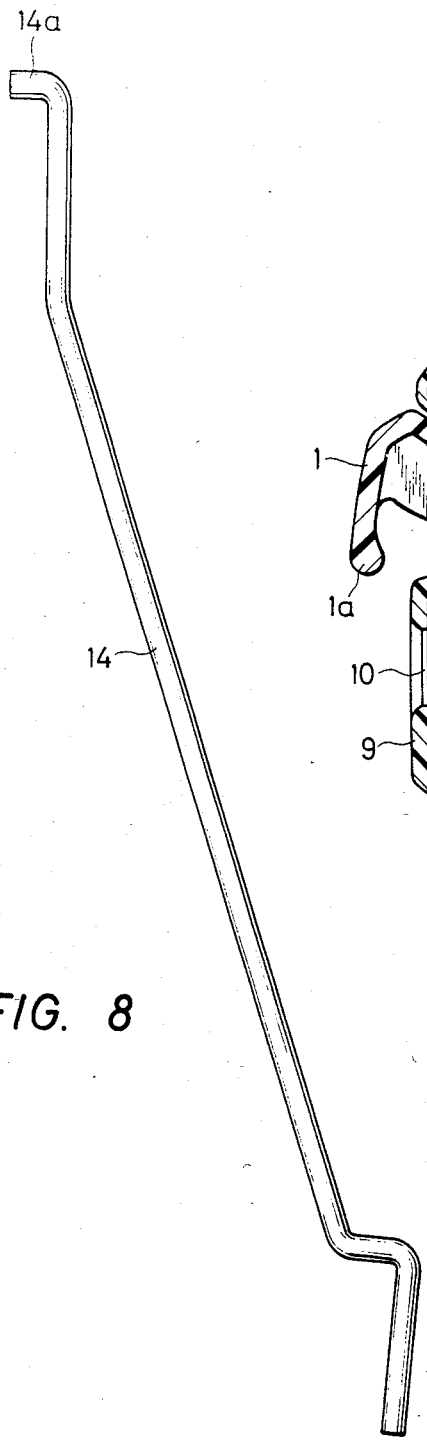
FIG. 8 is a side view of the door latch-operating rod.
Figure 7:
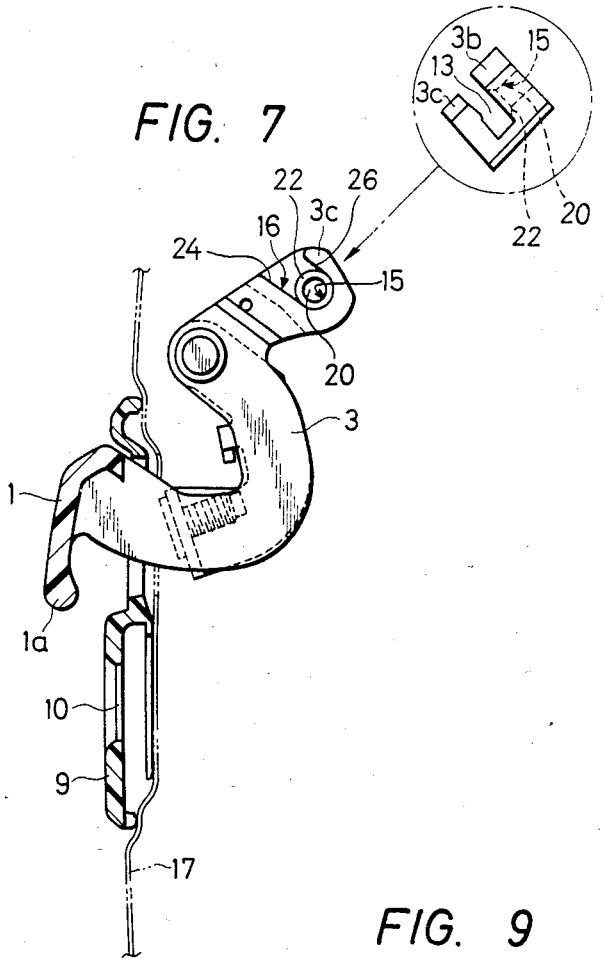
FIG. 7 is a cross-section taken along the section line VII—VII′ shown in FIG. 1.

The handle arm proper- and -projecting arm combination is pivotable at 4 and 5 relative to a bracket 6 rigidly connected at 7 and 8 with a housing piece 9 and a conventional automotive door panel which is not shown for avoiding possible confusion of the drawn parts and on account of its very popularity so far as FIGS. 1 and 2 are concerned. However, the door panel is shown at 17 in FIG. 4 and the like.

The housing piece 9 is formed with a hole 10 adapted for receiving a conventional cylinder lock, not shown.

The arm projection 3 is provided at its free end with the pivot pin 5 made rigid therewith by press job, as an example, said pin carrying thereon the body part of a return coil spring 11 having first extension 11*a* abutting against a shoulder 3*a* formed on the arm projection 3. The spring 11 has another extension 11*b* which abuts on a projection 12 extending rigidly from the bracket 6 (refer specifically to FIG. 2). The pivot pin 5 is formed at its inner end with an enlarged head 5*a* for the prevention of unintentional slip-out of the coil spring.

The free end of arm projection 3 is formed into two arm elements 3*b* and 3*c* so as to provide an idle space 13 therebetween for allowing a turning movement of the end bend 14*a* of latch-operating rod 14 when assembling.

Inner arm element 3*b* is formed with a round opening 15 including a truncated conical portion adapted for receiving the said rod end 14*a*. Opening 15 includes truncated conical portion 22 and cylindrical opening 20. The truncated conical portion tapers inwardly to the cylindrical opening from a side of arm element 36 located adjacent to idle spare 13. One end of the truncated conical portion 22 is located at a side arm element 3*b* and has a diameter greater than the diameter of the L-shaped end of the door latch rod and the other end of the truncated conical portion 22 terminates at cylindrical opening 20 which has a diameter equal to the diameter of the L-shaped end of the door latch rod. Outer arm element 3*c* has a hook shape so as to provide an introduction recess 16 including opposed guide surfaces 24, 26 tapering inwardly towards curved bottom 16*a* of introduction recess 16 which is adapted for introducing the rod end 14*a*, as will be later more fully described. The curved bottom 16*a* is in alignment with and extends parallel to an outer edge of the largest diameter portion of the truncated conical portion 22. One end of each of the guide surfaces 24, 26 is spaced in distance greater than the diameter of the door latch rod and the other end of each of the guide surfaces 24, 26 terminates at the curved bottom 16*a* of introduction recess 16.

Figure 3:
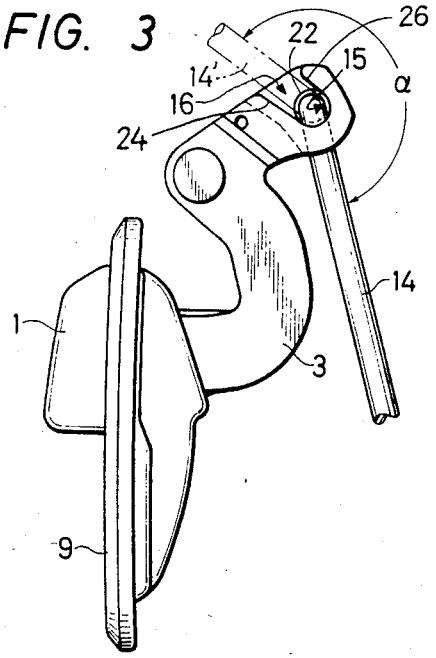
FIG. 3 is a side view of a handle arm-latch operating rod connection.
Figure 5:
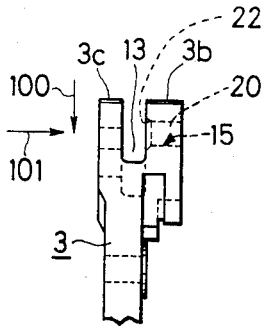
FIG. 5 is a detail front view of one of the handle arm projections which is adapted for receiving the top end of the latch operating rod.
Figure 9:
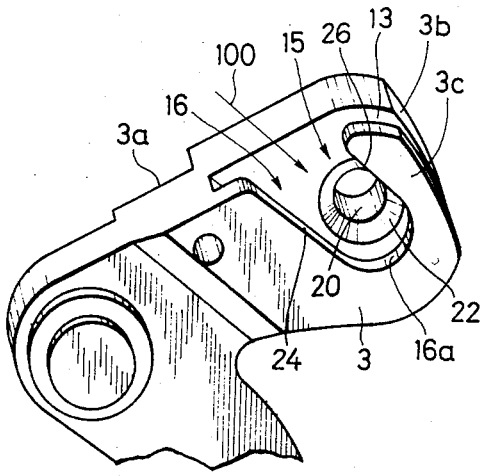
FIG. 9 is an enlarged side of an outer arm element 3*c*.

When assembling the outside door handle assembly, the sub-assembly is assembled as is shown in FIGS. 1 and 2. For attaching the door latch operating rod 14 thereto, the workman grips it by his hand substantially at the middle thereof, directing however its L-shaped end substantially downwards, and introduces such rod end into the open groove 16 of the arm element 3*c* by sliding the L-arm portion along the side walls of the groove, until the L abuts on the bottom 16*a* of the latter, as hinted by an arrow 100 shown in FIGS. 5 and 9. At this stage, the L-arm 14*a* points towards the hole 15 and is brought into registration therewith. Then, the operator exerts a light-hand pressure onto the rod end 14*a* in the direction perpendicular to the plane of FIG. 9 and as shown by a further arrow 101 in FIG. 5, the L-arm of the rod 15 is inserted through the rod-receiving opening 15 and the body of rod 14 is brought into registration with idle space 13 between the both arm elements 3*b* and 3*c*. This position is schematically shown in chain-dotted lines 14' in FIG. 3. Finally, the rod 14 is turned, say alpha, 220 degrees in FIG. 3 around the rod's L-arm or the axis of opening 15, so as to bring the rod into its regular service position shown in FIG. 3 in full lines at 14. Naturally, the said rod-turning angle alpha, 220 degrees may be modified according to design.

Thus, the rod 14 can be set in a push-in and turning mode without execution of any additional after fabrication. Therefore, according to this invention, the assembly job of the outside door handle with the latch operating rod can be highly simplified and economized.

The operational mode of the present outside door handle assembly is the same as conventional. By raising manually the handle arm 1 upwards against the action of return coil spring 11, motion is transmitted therefrom through the rod 14 towards the latch operating mechanism, not shown, for release of the door latch, again not shown. By release the operator's hand from the outside door handle, the latter is brought to its off-service position shown in FIGS. 1 and 2.

The Embodiments of the invention in which an exclusive property or privilege is claimed are as follows:

1. A door handle assembly for operating a door latch mechanism by a door latch rod, one end of said door latch rod engaging the door latch mechanism and the other end of said door latch rod having an L-shape end engaging the door handle assembly, said door handle assembly comprising:

a door handle adapted to be pivotably mounted on a door, an arm projection fixed at one end to said door handle and a free end of said arm projection defining two parallel arm elements, an idle space defined between said two arm elements allows for a turning movement of said L-shape end of said door latch rod therethrough, one of the two parallel arm elements defining a lateral circular opening for receiving said L-shape end of the door latch rod and the other of said two parallel arm elements defining an introduction recess including two opposed guide surfaces tapering inwardly towards a curved bottom section located at the base of said introduction recess, said curved bottom section is in alignment with and extends parallel to an outer edge of said lateral circular opening, one end of each of said guide surfaces being spaced from each other a distance greater than the diameter of said door latch rod, the other end of each of said guide surfaces terminating in said curved bottom section, said lateral circular opening including a truncated conical portion tapering inwardly to a cylindrical opening from a side of said one arm element located adjacent to said idle space, one end of said truncated conical portion located at said side of said one arm element has a diameter greater than a diameter of said L-shape end of the door latch rod and the other end of said truncated conical portion terminates at said cylindrical opening having a diameter substantially equal to the diameter of said L-shape end of the door latch rod, a center axis of the lateral circular opening extends transversely through the introduction recess, and the door latch rod being guided through the introduction recess for aligning said L-shaped end of the door latch rod with the lateral circular opening while the L-shape end of the door latch rod is being pushed through said introduction recess into said lateral circular opening and said door latch rod is then rotated between said two parallel arm elements through an arc of rotation having an axis coincident with the center axis of the lateral circular opening.

* * * * *